US011965726B2

(12) United States Patent
Pourcenoux et al.

(10) Patent No.: US 11,965,726 B2
(45) Date of Patent: Apr. 23, 2024

(54) ROCK DRILLING UNIT AND METHOD FOR CHARGING DRILLED HOLES

(71) Applicants: SANDVIK MINING AND CONSTRUCTION OY, Tampere (FI); SANDVIK MINING AND CONSTRUCTION LYON SAS, Meyzieu (FR)

(72) Inventors: Jerome Pourcenoux, Columbus (FR); Remy Barraud, Meyzieu (FR); Sylvain Chavand, Meyzieu (FR); Laurent Demia, Meyzieu (FR)

(73) Assignee: Sandvik Mining and Construction Oy, Tampere (FI)

( * ) Notice: Subject to any disclaimer, the term of this patent is extended or adjusted under 35 U.S.C. 154(b) by 184 days.

(21) Appl. No.: 17/777,709

(22) PCT Filed: Nov. 18, 2020

(86) PCT No.: PCT/EP2020/082565
§ 371 (c)(1),
(2) Date: May 18, 2022

(87) PCT Pub. No.: WO2021/099404
PCT Pub. Date: May 27, 2021

(65) Prior Publication Data

US 2023/0003498 A1 Jan. 5, 2023

(30) Foreign Application Priority Data

Nov. 19, 2019 (EP) ..... 19210047

(51) Int. Cl.
*F42D 1/22* (2006.01)
*E21B 7/02* (2006.01)
*E21C 37/00* (2006.01)

(52) U.S. Cl.
CPC ..... *F42D 1/22* (2013.01); *E21B 7/025* (2013.01); *E21C 37/00* (2013.01)

(58) Field of Classification Search
CPC ... F42D 1/22; F42D 1/10; E21B 7/025; E21B 7/022; E21B 7/20
See application file for complete search history.

(56) References Cited

U.S. PATENT DOCUMENTS 4,344,599 A * 8/1982 Herron ..... E21B 7/022 173/28
4,508,035 A * 4/1985 Mashimo ..... E21B 7/025 299/13
4,592,282 A * 6/1986 Niemi ..... F42D 1/10 299/13
7,644,782 B1 * 1/2010 Coogan ..... E21B 15/045 173/1

(Continued)

FOREIGN PATENT DOCUMENTS

AU 2008345507 B2 7/2011
SE 1450819 A 7/2014

*Primary Examiner* — Joshua E Freeman
(74) *Attorney, Agent, or Firm* — Corinne R. Gorski

(57) ABSTRACT

A rock drilling unit and method for charging drilled holes. The rock drilling unit includes a feed system for feeding initiators and rock breaking material into the drilled holes. The rock drilling unit is also provided with one or more communicating devices for communicating with the wireless initiators.

17 Claims, 6 Drawing Sheets

(56) References Cited

U.S. PATENT DOCUMENTS

| | | | | |
|---|---|---|---|---|
| 7,942,481 | B2 * | 5/2011 | Leppanen | E21B 7/007 299/13 |
| 8,418,618 | B2 * | 4/2013 | Ahola | E21B 7/025 175/2 |
| 10,359,265 | B2 * | 7/2019 | Van Wyk | F42D 1/055 |
| 2008/0011516 | A1 * | 1/2008 | Piipponen | E21B 7/20 175/57 |
| 2010/0270076 | A1 * | 10/2010 | Ahola | E21B 7/025 175/2 |
| 2011/0182672 | A1 * | 7/2011 | Nystrom | E21D 20/028 405/259.5 |
| 2013/0098257 | A1 * | 4/2013 | Goodridge | F42B 3/113 102/201 |
| 2016/0123146 | A1 * | 5/2016 | Makela | E21B 3/00 701/50 |
| 2017/0037725 | A1 * | 2/2017 | Uotila | E21B 7/025 |
| 2017/0114594 | A1 * | 4/2017 | Anttonen | E21B 6/04 |
| 2017/0138192 | A1 * | 5/2017 | Wang | E21D 9/006 |
| 2017/0356292 | A1 * | 12/2017 | Wang | E21B 7/025 |
| 2018/0106584 | A1 * | 4/2018 | Santos | F42D 1/10 |
| 2018/0187540 | A1 * | 7/2018 | Hanski | E21B 47/04 |
| 2018/0216451 | A1 * | 8/2018 | Huikkola | E21B 44/08 |
| 2020/0173764 | A1 * | 6/2020 | Piipponen | E21B 7/025 |
| 2021/0404292 | A1 * | 12/2021 | Jaakkola | E21B 41/00 |
| 2022/0349692 | A1 * | 11/2022 | Sanchez | F42B 39/30 |
| 2022/0412713 | A1 * | 12/2022 | Sanchez | F42D 1/045 |

* cited by examiner

ROCK DRILLING UNIT AND METHOD FOR CHARGING DRILLED HOLES

RELATED APPLICATION DATA

This application is a § 371 National Stage Application of PCT International Application No. PCT/EP2020/082565 filed Nov. 18, 2020 claiming priority to EP 19210047.7 filed Nov. 19, 2019.

BACKGROUND OF THE INVENTION

The invention relates to a rock drilling unit intended for drilling drill holes to rock material and also provided with means for charging the drilled holes with rock braking material.

The invention further relates to a method of charging drilled holes.

The field of the invention is defined more specifically in the preambles of the independent claims.

In mines boulders and rock surfaces may be broken by using drill and blast techniques where holes are at first drilled into rock material and then explosive charges are placed in the drilled holes. When the explosives are initiated, shock waves and produced gas pressure cause the rock material to crush, fracture and disintegrate into smaller pieces. The explosives are initiated by means of initiators, which are connected with electric wires to a firing device. Managing the wires is difficult. Therefore wireless initiators has been developed. However, handling and managing the wireless initiators have also shown to include disadvantages.

BRIEF DESCRIPTION OF THE INVENTION

An object of the invention is to provide a novel and improved rock drilling unit and method for charging drilled holes.

The rock drilling unit according to the invention is characterized by the characterizing features of the independent apparatus claim.

The method according to the invention is characterized by the characterizing features of the independent method claim.

An idea of the disclosed solution is that a rock drilling unit of a rock drilling rig is provided with an initiator feed system for feeding initiators inside drilled holes in order to activate rock breaking material also fed inside the drilled holes. The initiator feed system of the drilling unit is provided with at least one communicating device for providing wireless communication with the initiators. The communication device is in data connection with at least one control unit external to the drilling unit. Further, the communication device is configured to determine identification of the initiator and provides identification data to link the initiator to at least one dedicated data element.

An advantage of the disclosed solution is that managing of the initiators is improved which has positive impact on operational quality and effectiveness. The communication capability offers possibility to implement remote controlled, and also fully automatic handling and feeding of the initiators. For safety reasons the initiators can be handled at the remote drilling unit whereby operator of the rock drilling rig has no possibility to manually monitor and influence to the handling and feeding steps.

According to an embodiment, the linking between the ID and the dedicated data element is executed by means of the communication device itself. Then the communication device is provided with a processor for executing the linking and a memory device for storing the data elements. In this embodiment the communication device is a smart device.

According to an embodiment, the linking between the ID and the dedicated data element is executed by means of the external control unit. A control unit of the rock drilling rig may serve as the external control device, or alternatively, the external control unit may be located at a control room or may be a portable electric terminal device, such as a laptop computer or smart phone. Further, the communication device may also communicate with a cloud service, whereby the data elements may be stored therein and one or more servers may execute the linking.

According to an embodiment, the mentioned data element comprises at least data on the drilled hole inside which the initiator is configured to be fed. It is possible to gather and store a large amount of data relating to the drilled holes and this data may now be linked to the handled initiators.

According to an embodiment, the mentioned data on drilled holes comprises position data, such as coordinates in a mine coordinate system or work site coordinate system, or relative coordinates between the initiators. The position data may alternatively comprise more coarse data including location relating to a shape of a boulder which is about to be broken. Further, the position data may comprise mine specific position data such as data on mine work sites and mine chutes. Position data can be gathered during the drilling phase since the drilling boom is provided with sensors and also location of a carrier of the rock drilling rig is known by a positioning system. Control unit of the rock drilling rig may calculate continuously position of the drilling unit whereby positions of the drilled holes are known.

According to an embodiment, the above mentioned data on drilled holes may comprise data on direction of the drilled holes. The data element may also comprise data on straightness, direction and length of the drilled holes. Further, data relating to success of the drilling and possible deviations may also be stored. All this data can be gathered during the drilling relatively easily and may be stored.

According to an embodiment, the data on drill holes is gathered during the drilling and is stored into the storage device as one or more data elements to be used in the charging and blasting measures. The gathered drill hole data can be utilized when setting delay times of the initiators, such as detonators, for example. Further, the data may be utilized when analyzing blasting results later on.

According to an embodiment, the control unit is provided with at least one drill hole data element for storing position data of the drilled holes. The initiators fed to the drilled holes are linked to the drill hole data element by means of individual identification codes of the initiators, whereby positions of the fed initiators are known. The linked position data may be submitted to the detonating system so that desired initiators may be triggered in a pre-planned order and manner.

According to an embodiment, the communication device is provided with at least one optical sensor or reader for remote reading visible markings or even light patterns on outer surfaces of the initiators. In this embodiment the markings need to be in visible to the reader. There may be a transparent window or opening in the feed system for allowing the reading. Alternatively, the reader may extend to an inner surface side of a feed tube or storage space and thereby allow the visual detection. The optical reader may read remotely optical characters, codes and sigs, such as bar codes and QR codes. Then, such optical markings and codes visible on outer surfaces of the initiators can be recognized and utilized. The markings can be printed or marked directly on the initiators or suitable labels and stickers may be used.

When optical sensing is applied, then markings may be arranged around the initiator so that they can be detested regardless of orientation of the initiator. Scanning or reading view angle may be selected to be wide enough in order to facilitate the reading. Alternatively, or in addition to, there may be an arrangement for guiding and ensuring that the markings of the initiator are positioned in front of the optical sensor or reader in a predetermined reading attitude relative to its longitudinal axis and angular position. A further possibility is to provide the optical sensor with a moving device. Then the sensor may search the markings and may move to a proper reading position relative to the optical markings on the initiator.

According to an embodiment, the communication device is provided with at least one data communication interface for wireless communication with the initiator by means of electromagnetic radiation. The electromagnetic radiation can penetrate through obstacles, such as through walls of feeding tubes of the feed system. Further, in this embodiment the communication device may be positioned on the drilling unit more freely. The initiator may be provided with a tag or signaling device for providing the communication between the initiator and communication device.

According to an embodiment, the mentioned wireless communication may be based on short range radio transfer.

According to an embodiment, the wireless communication may utilize one of the following available data communication technologies based on use of the electromagnetic radiation and signaling devices: Bluetooth (BT), Near Field Communication (NFC), Infrared (IR), Ultrasonic sensors and custom radio frames.

According to an embodiment, the communication device is configured to monitor status of the initiator. The mentioned status monitoring may include monitoring condition of the initiator i.e. ensuring that the initiator is working properly. The status monitoring may also include determining whether the initiator is armed and operable or not. A further possibility is to monitor and test communication capability and quality of the initiator. When two physical rock breaking components are connected together at the rock drilling unit, then the condition monitoring may include monitoring that the connection between the components is in accordance with requirements. If deviations are noted in the monitoring, it is still possible to make corrective measures in the charging process and to thereby ensure that the rock breaking is done properly and safety issues have been taken care of.

According to an embodiment, when the initiator is connected to another physical charging component before the feeding, then the above mentioned monitoring may occur. In order to implement the monitoring, at least one of the components being connected may be provided with one or more electrical indicators for detecting success of the connection. In case the connection is failed, then the initiator may be disarmed and may be removed from the feed line. Then new rock breaking components are connected and fed into the drilled hole. The electrical indicator may send a radio wave signal or light signal for indicating the status of the made physical connection between the components.

According to an embodiment, the communication device is configured to adjust properties of the initiator itself. This way the initiator may be prepared and modified to suit best for different situations.

According to an embodiment, the communication device is configured to provide the initiator with at least one of the following input data: identification code (ID), location data, status data, delay for ignition, delay to be armed, key code to communicate with the initiator. Thus, the initiator may be provided with the added or modified data just before being fed into the drilled hole. The initiator may comprise a memory device for storing the input data.

According to an embodiment, the disclosed solution comprises providing the initiator with an identification code or data by means of the communication device. In other words, the initiator is not initially provided with a predetermined identification data, but instead, the identification data is generated only prior to feeding inside the drilled hole. The communication device may be provided with an encoder or corresponding device for providing a tag or memory device with a proper code or individual naming. Alternatively, the communication device or the assembly device mentioned in this document may attach a separate tag or other remote readable identification element comprising an individual code on the initiator.

According to an embodiment, the communication device is provided with at least one wireless data communication device for generating one-way data transmission path from the initiator to the communication device or vice versa.

According to an embodiment, the communication device is provided with at least one wireless data communication device for generating a two-way data transmission path between the initiator and the communication device. Then the data can be changed in both directions, which allows more versatile possibilities to influence properties and use of the initiators.

According to an embodiment, the communication device is mounted in connection with a feed line of the initiator or charge feed system. The communicating device may be fastened to a feed beam of the drilling unit or to components mounted on the feed beam. When the communicating device is mounted close to the feed line, then reliability of the communication path is ensured, which is advantageous in harsh mine conditions. It is also possible to place the communication device as close to a distal end of a feed beam of the drilling unit as possible.

According to an embodiment, the rock drilling unit comprises at least one magazine for storing several initiators. The communication device may be mounted in connection with the magazine. The communication device may be mounted on an outer surface of the magazine, for example. Alternatively, at least one inner space of the magazine may be provided with the communication device.

According to an embodiment, the rock drilling unit comprises two magazines wherein a first magazine is for storing the initiators and a second magazine is for storing rock breaking material cartridges, such as so called boosters. At least the mentioned first magazine is provided with the communicating device. In an alternative solution, the communicating device is located on the feed line downstream the first magazine. The use of two magazines helps splitting primary and secondary explosives from each other and to thereby decrease hazards and risks.

According to an embodiment, the rock drilling rig comprises two magazines wherein a first magazine is for storing the initiators and is located on the drilling unit, and a second magazine, which is for storing rock breaking material and is located on the carrier of the rock drilling rig. At least the mentioned first magazine on the drilling unit is provided with the communicating device. In an alternative solution, the communicating device is located downstream the first magazine. Between the mentioned magazines may be a bendable guide tube or hose.

According to an embodiment, the rock drilling unit comprises an assembly unit for connecting the initiator and a booster to form an assembly. The booster is a small rock breaking cartridge comprising secondary explosive material. Connection between the initiator and the booster may be based on mechanical clips, locking elements, bayonet coupling, screw surfaces, interference fitting, magnetism, for example. The assembly unit may be provided with the connecting device for communicating with the assembly. The assembly may comprise one or more electrical indicators for indicating success of the connection between the elements. The connection indicator may send a signal when the connection is in order, or alternatively it may indicate if false connection occurs.

According to an embodiment, at least one communicating device may be located downstream the mentioned assembly unit. Then the communication may still be made only just before the initiator leaves the rock drilling unit or when it is only a few centimeters inside the drilled hole. This embodiment allows execution of a final check.

According to an embodiment, there may be several communication devices on the drilling unit in order to ensure proper communication, registration, adjustments and other disclosed measures of the charged items before leaving the drilling unit. In other words, there may be communication possibility in storage spaces, after assembly with other components and just immediately before being pushed away from the drilling unit. All these measures allow automated, unmanned, effective and safe handling of the inserted items.

According to an embodiment, the disclosed solution relates to a method of charging breaking material into drilled holes. The method comprises: drilling drill holes to a rock surface by means of a rock drilling machine of a rock drilling unit; feeding a wireless initiator into the drilled hole after the drilling is completed; executing the feeding of the initiator by means of feeding means provided by the rock drilling unit; providing the drilling unit with at least one communication device; and communicating by means of the communication device with each initiator just before being fed into the drilled hole. Thus, the same drilling unit is used not only for the drilling but also for charging the completed drilled holes. Then there is no need for separate charging vehicles or to provide the rock drilling rig with special charging booms. And further, there is no need for manual manipulation of different initiators and rock breaking materials. The method may further comprise feeding rock breaking material into the drill hole after the initiator has been fed. The rock breaking material may have bulk-like or cartridge-like configuration.

In some cases the initiator or combination of the initiator and the booster (small charge explosive) may cause required rock breaking forces even without the use of any additional rock breaking material. This is true especially when boulders need to be broken for releasing blocked mine chutes. The initiator may be a detonator, a compound of a primary explosive and secondary explosive or another technology such as a chemical expansion assembly. The initiator may be self-sufficient or it may integrate primary explosive and may itself contain enough secondary explosive.

According to an embodiment, the method further comprises determining identification of each initiator and connecting the initiator to at least one data element in response to the detected identification. Thus, the solution offers versatile ways to manage different initiator related data in efficient manner. Improved amount of data and its improved management has positive impact for fluent and cost effective operation at the mine.

According to an embodiment, the disclosed solution relates to a communication device, which is mountable to a drilling unit of a rock breaking rig. The communication device is configured to provide contactless communication with at least one initiator intended for launching rock breaking material into action. The communication device is designed for the special use in connection with the drilling unit and it endures harsh mining conditions and is provided with suitable fastening means. According to a detailed embodiment, the communication device is provided with an optical reader for remote reading optical characters, codes and sigs, such as bar codes and QR codes. Then, such optical markings and codes visible on outer surfaces of the initiators can be recognized. According to another detailed embodiment, the communication device is provided with at least one wireless data communication or transmission device for generating a data communication path between the communication device and the initiator. According to an embodiment, the communication device is provided with at least one electrical and wireless data communication or transmission device operation of which is based on frame of radio waves. In other words, the communication device comprises a radio receiver or transceiver (receiver/transmitter). Alternatively it may comprise IR transmitter and receiver. According to a detailed embodiment, the communication device is configured to communicate with a tag attached to the initiator. According to an embodiment, the communication is based on RFID—Radio frequency identification, i.e. signaling between the tag and the reader. According to an embodiment, the communication is based on NFC—Near field communication. NFC enables two electronic devices to establish communication by bringing them within 4 cm. NFC tags may be used and they may comprise passive data stores that can be read, or active data stores which can be written too.

According to an embodiment, the solution may relate to a rock drilling rig, comprising: a movable carrier; at least one drilling boom connected movably to the carrier and equipped with a rock drilling unit; and wherein the rock drilling unit comprises a feed beam and a rock drilling machine supported movably on the feed beam; and wherein the drilling unit is in accordance with the features disclosed in this document and includes the disclosed communicating device for communicating with initiators before they are fed into the drilled holes drilled by the rock drilling machine.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
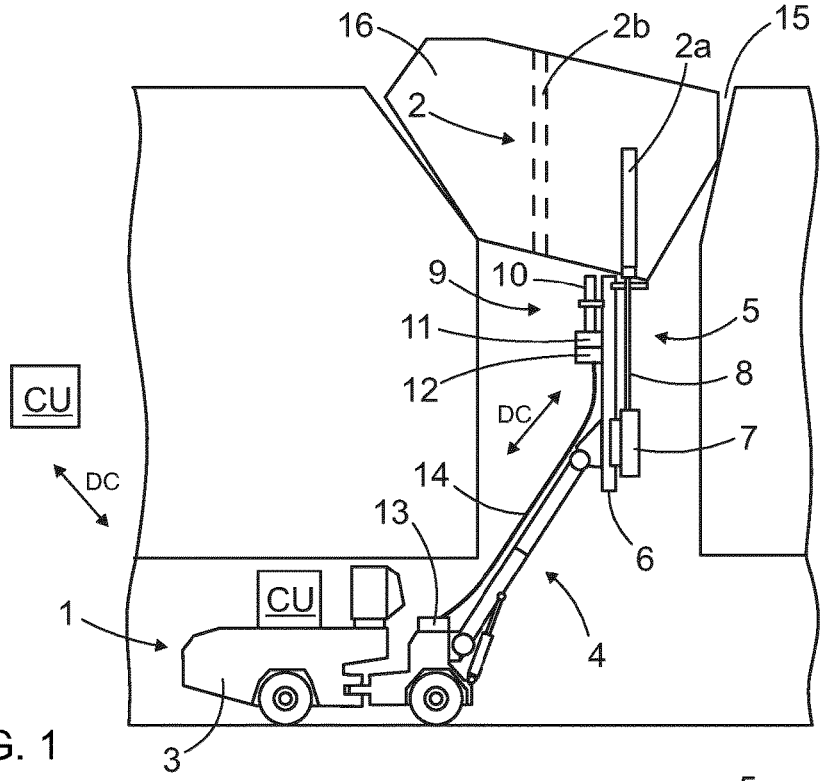
FIG. 1 is a schematic side view of a rock drilling rig positioned at a mine chute and trying to break a boulder blocking the chute.

FIG. 1 shows a rock drilling rig 1 intended for drilling drill holes 2 and charging them after the drilling with rock breaking material. The rock drilling rig 1 comprises a movable carrier 3 and one or more drilling booms 4 connected to the carrier 3. At a distal end portion of the drilling boom 4 is a drilling unit 5 provided with a feed beam 6 and a rock drilling machine 7 supported on it. A drilling tool 8 is connectable to the drilling machine 7. The drilling unit 5 is further provided with a feed system 9 configured to feed initiators and rock breaking material into the drill holes 2. The feed system 9 may comprises devices or units 10-12 mounted on a feed beam 6 and one or more devices 13 mounted on the carriage 3. Between the carriage 3 and the drilling unit 5 may be a guide hose 14 for transferring rock breaking material from the carrier 3 to the drilling unit 5. The rock breaking material could be bulk or cartridges. The rock breaking material may be embedded in the initiator or inserted in a second phase in the process. The feed system on-board the rock drilling unit may be indexed on a drilled hole line after the drilling or alternatively it may be positioned by means of the drilling boom. However, the drilling unit is provided with the needed apparatuses for the drilling and charging.

Operation of the drilling unit 5 and the feed system 9 is controlled by means of a control unit CU mounted on-board the carrier. The same control unit may control apparatuses and systems of the entire rock drilling rig 1. The on-board control unit CU may communicate with one or more external control units CU. Data communication connections or paths DC are also shown in FIG. 1. The communication path may be based on wired communication, or alternatively wireless technologies may be applied.

In FIG. 1 the rock drilling rig 1 is positioned at a mine chute 15 which is blocked by a boulder 16. Drill holes 2 are drilled to the boulder where after rock breaking material is fed into the drilled holes. When a wireless initiator, which is also fed to the drilled hole, is triggered then the boulder will break and the chute 15 is unblocked. Number of the drilled holes 2 as well as their location, direction and length may vary. There may be blind holes 2*a* and through holes 2*b*, for example. When the boulder is provided with several charged drill holes, defined delays may be utilized between their initiation as well as different initiation patterns and sequences.

Further, the rock drilling rig 1 may be operated manually by means of an operator or it may be an unmanned device, which may be remote controlled via teleoperation or it may be a fully automated machine. In all cases there is a need for automated drilling sequences as well for automated charging process. The disclosed solution provides improvements for automating charging of wireless initiators and automated feeding of rock breaking material.

Figure 2:
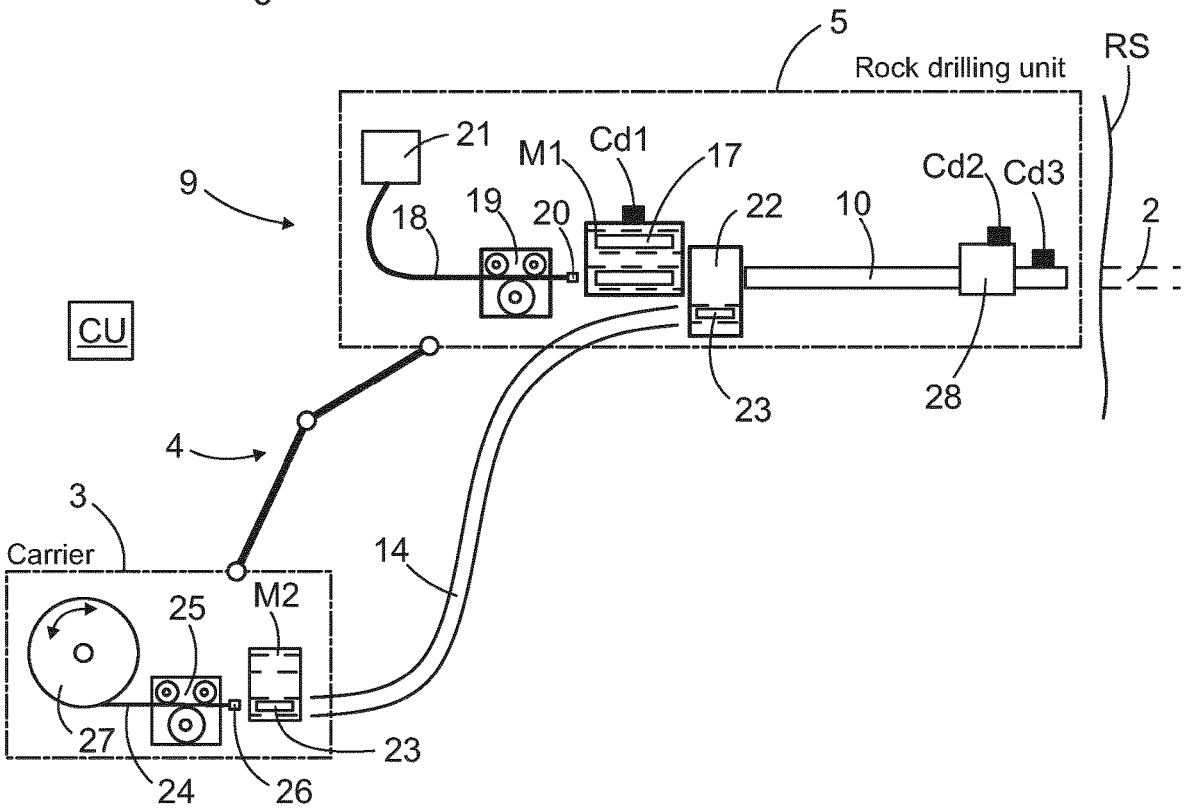
FIG. 2 is a schematic view of the disclosed charging solution comprising a feeding system for feeding initiators and explosive material into drilled holes and also being capable to communicate with the fed initiators.

FIG. 2 discloses a feed system 9 comprising a feed tube 10 which may be positioned in alignment with a drilled hole 2 drilled on a rock surface RS. Initiators 17 may be stored in a first magazine M1 and may be moved by means of a pushing hose 18 away from the first magazine M1 towards the feed tube 10. The pushing hose 18 may be moved by means of a first feed device 19 and at a distal end of the pushing hose 18 may be plug 20. Further, the pushing hose 18 may serve as a feeding path for bulk-like rock breaking material such as explosive emulsion or powder. Thus, the opposite end of the pushing hose 18 may be connected to a rock material feed apparatus 21 or storage. The feed system 9 may further comprise a receiver device 22 which is connected by means of the guide hose 14 to a second magazine M2, which is configured to store several boosters 23 or corresponding small explosive cartridges. The second magazine M2 may be located on a carrier 3 of the rock drilling rig. The boosters 23 may be moved from the second magazine M2 via the guide hose 14 to the receiver device 22 by means of a bendable pushing cable 24 or hose. The pushing cable 24 may be moved by means of a second feed device 25 and there may be plug 26 at the end of the pushing cable 24. The pushing cable 24 may be wound on a cable drum 27. The receiver device 22 may receive the booster 23 and may move the booster 23 on a feed line.

At first the initiator 17 is pushed by means of the pushing hose 18 along the feed line to an assembly module 28 and when the initiator 17 is stopped at the assembly module 28, the pushing hose 18 is retracted. Thereafter the booster 23 is fed by means of the receiver device 22 on the feed line and again the pushing hose 18 is moved forwards so that the booster 23 is following the initiator 17 to the assembly unit 28. The initiator 17 and the booster 23 are connected to each other in the assembly module 23. When the connection is ready, the produced assembly is fed from the assembly unit 28 to the drilled hole 2 by means of the pushing hose 18. The assembly may be fed to the bottom of the drill hole or to a desired location inside the drill hole by means of the hose or cable 18. While the pushing hose 18 is retracted, bulk-like rock breaking material may be fed through it to the drill hole 2. In other words, the drill hole 2 may be filled partly or entirely by means of the rock breaking material, such as explosive emulsion. In some cases no bulk-like additional material is fed.

Further, it is possible to execute the feeding in a different way as described above. The booster 23 may be aligned on the feed line by means of the receiver device 22 and thereafter the hose 18 pushes the initiator 17 and the booster 23 together to the assembly unit 28. In this embodiment the booster 23 is located downstream relative to the initiator 17.

The rock drilling unit 5 may also comprise one or more communicating devices Cd1-Cd3 for providing wireless communication with the initiators 17 when they are still at the rock drilling unit 5. The first magazine M1 and the assembly unit 28 may be provided with the communicating devices Cd1 and Cd2. There may also be one communicating device Cd3 on the feed line after the assembly unit 28. Number and location of the communication devices may be selected according to need or technologies and the communication devices Cd may be in data connection with one or more control units CU external to the drilling unit 5. As it is disclosed above in this document the communication device Cd is configured to determine identification of the initiator 17 and may thereby provide identification data utilized for linking the initiator 17 to stored data elements.

Figure 3:
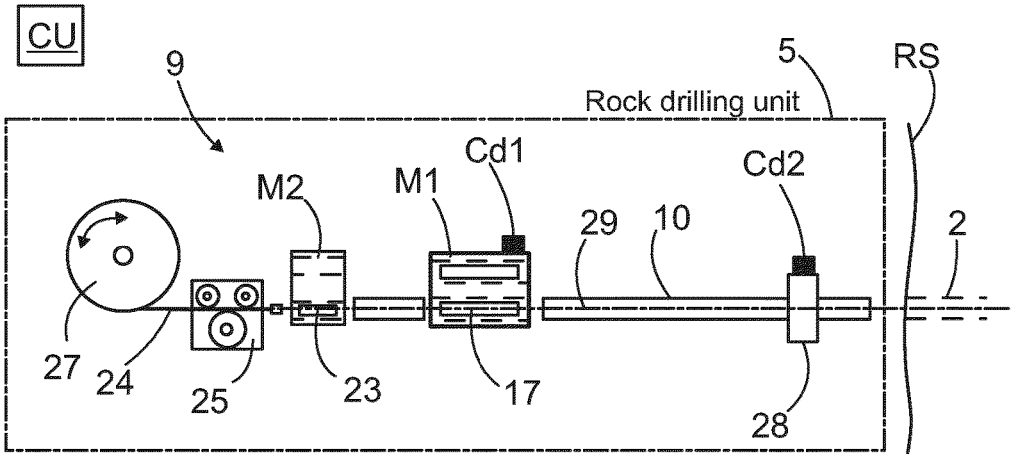
FIG. 3 is a schematic view of another feeding system wherein all the required mechanical components are mounted on a rock drilling unit.

The solution disclosed in FIG. 3 differs from the one shown in FIG. 2 in that the second magazine M2 for the boosters 23 is also located on the rock drilling unit 5. Furthermore, the cable drum 27 together with the pushing cable 24 and the feed device 25 are also mounted on the rock drilling unit 5. The cable drum may be a hose drum intended for feeding emulsion. No guide hose is need in this solution. The pushing cable 24 may or may not be capable of feeding bulk-like rock breaking material through it. When boosters 23 or corresponding small charges are enough for causing the desired rock breaking, then there is no even need for feeding any bulk-like explosives to the drill holes. As can be noted, there may be communication devices Cd1, Cd2 mounted close to the feed line 29 of the feed system 9.

The mentioned two magazines are preferably loaded in advance. The drilling rig can then move without explosive hazard to a dangerous zone to be blasted. Then manned operation in the dangerous zone is avoided. In a preferred solutions the two magazines have the same number of chambers and may be activated by the same actuator. The number of chambers is typically 3 to 10, but it could be easily extended.

Figure 4:
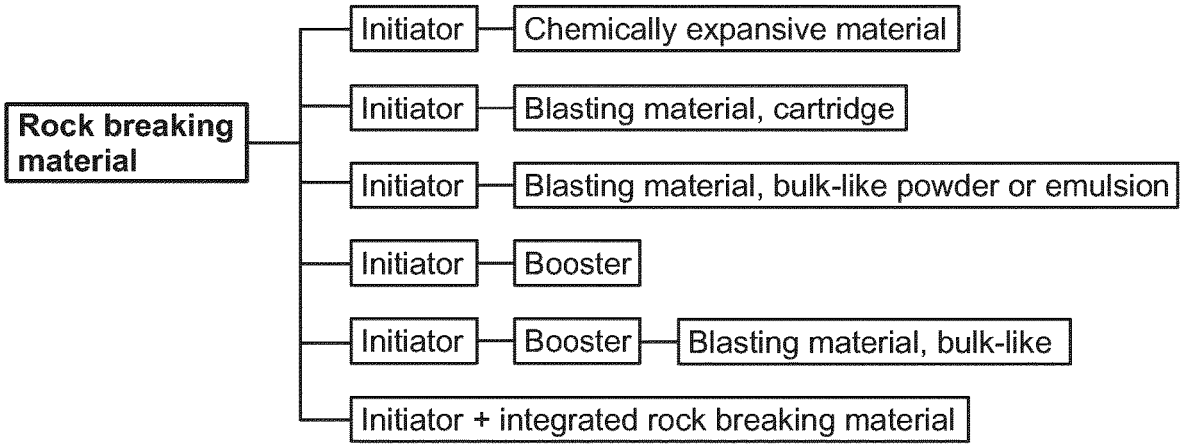
FIG. 4 is a diagram showing possible combinations of the fed rock breaking material.

FIG. 4 discloses some possible combinations of different rock breaking materials which may be handled and managed by means of the disclosed solution. Number of magazines, need for assembly unit and need for other devices disclosed above may be selected according to the used combination. The disclosed combinations have been explained already above in this document.

Figure 5:
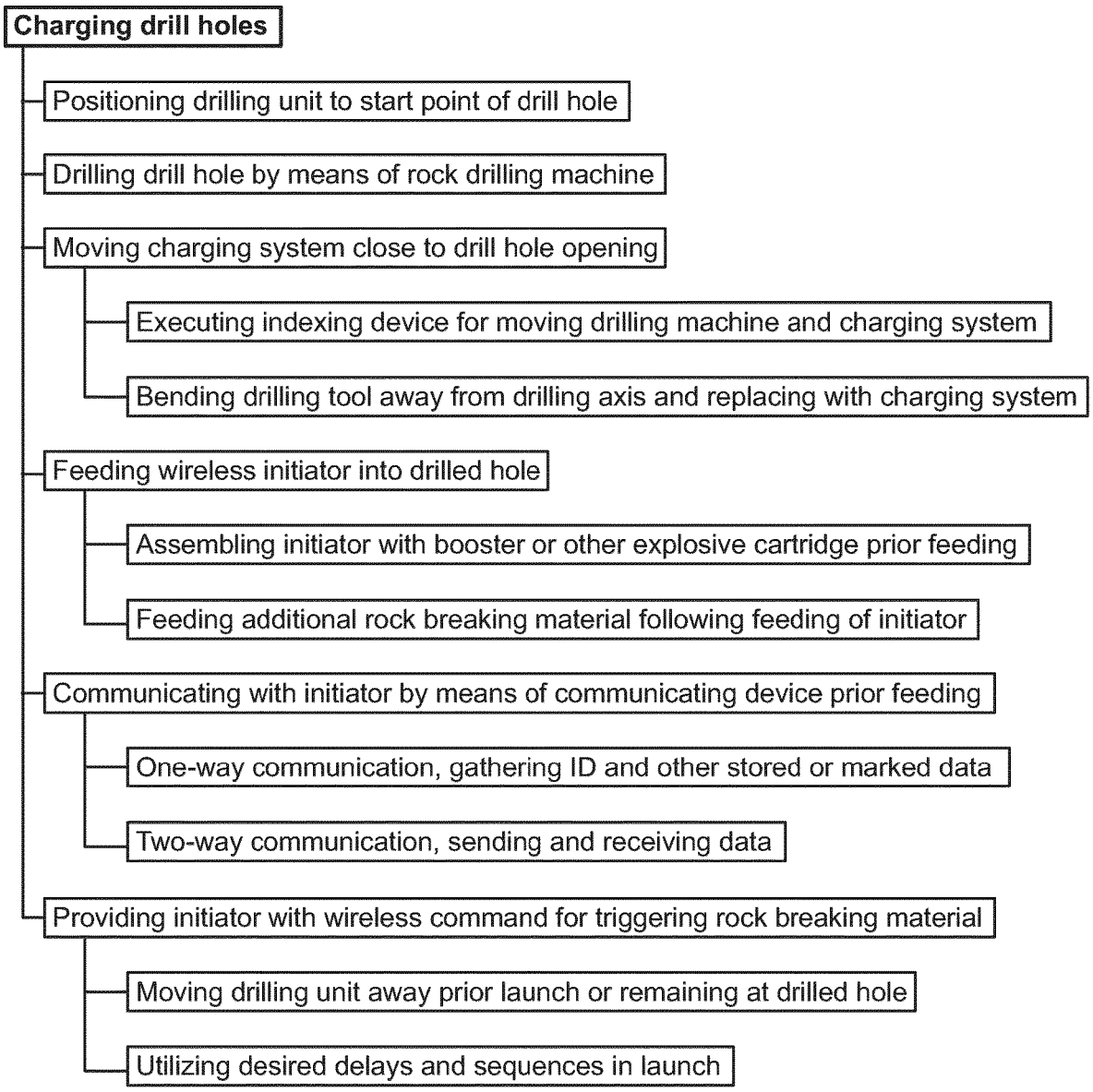
FIG. 5 is a diagram showing steps of the disclosed charging solution.

FIG. 5 discloses some features and steps relating to the disclosed charging method. The shown steps have been disclosed already above in this document.

It is to be noted that the steps of feeding and communicating could be all or partly exchanged, and further the feeding can be done two times.

Figure 6:
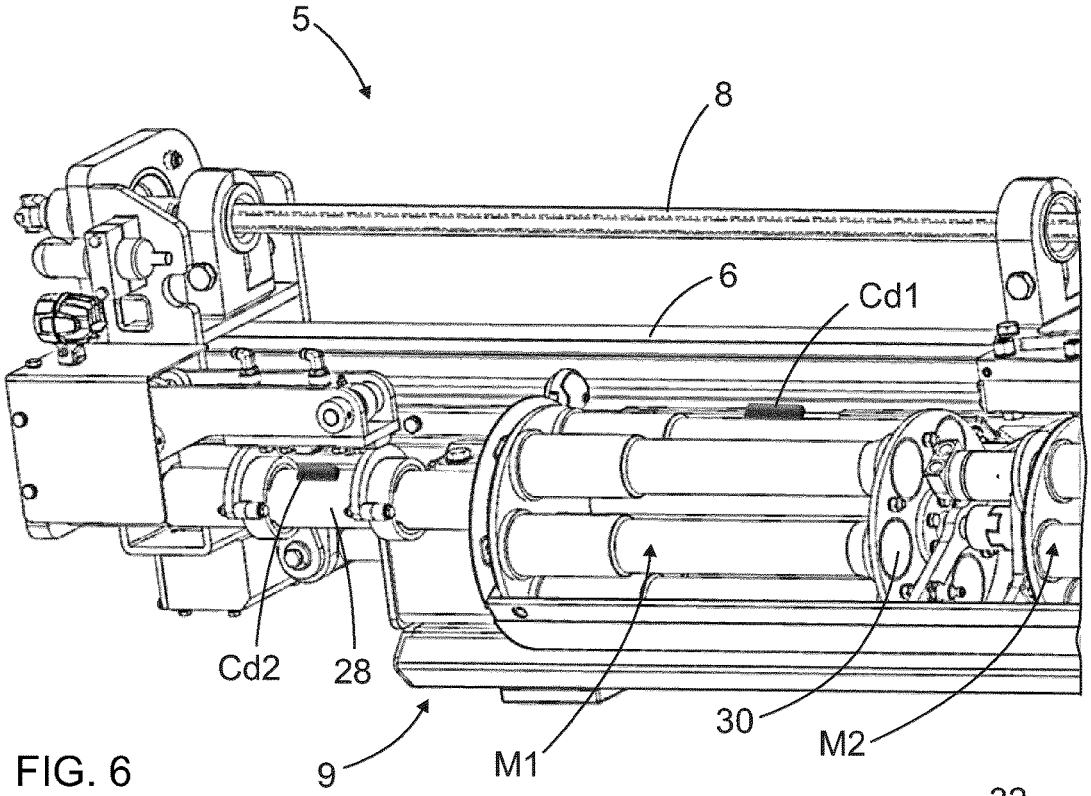
FIG. 6 is a schematic view of a front part of a rock drilling unit comprising magazines for the charged components and an assembly unit for connecting the components.

FIG. 6 discloses a front end portion of a rock drilling unit 5. There may be an assembly unit 28, a first magazine M1 and a second magazine M2 arranged successively on a feed line. As it is shown, the magazines M1 and M2 may both be rotatable structures comprising spaces 30 for receiving initiators, boosters and possible other rock braking cartridges. Further, two communication devices Cd1 and Cd2 are also shown. Both communication devices could be implemented or could be considered as alternatives.

Figure 7:
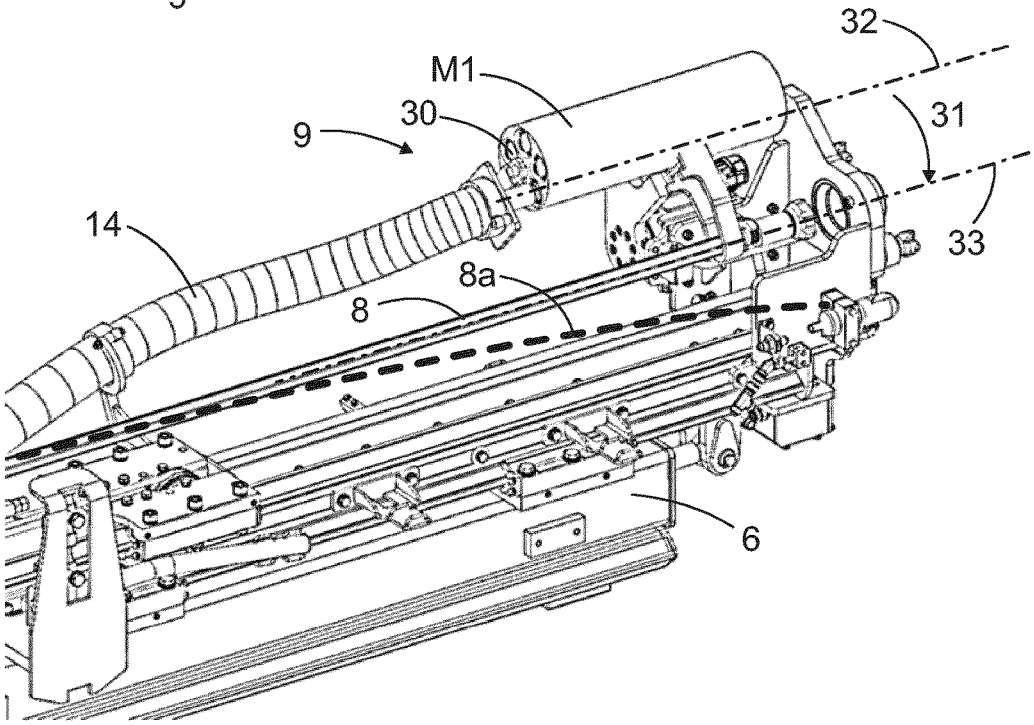
FIG. 7 is a schematic view of a front part of a rock drilling unit comprising magazine and indexing means for moving the feed system on a drilling axis for the duration of the charging.

FIG. 7 discloses a front end portion of a rock drilling unit 5. A feed system 9 may be configured to be moved 31 from an idle position 32 to drilling axis 33 whereby it pushes or deviates a front end portion of a drilling tool 8 laterally away from the drilling axis 33. Since the drilling tool 8 is a long and thin object it bends relatively easily in sideward direction without any plastic deformation and reverses into its original shape when the bending force is removed. The feed system 9 may comprise an actuator, such as a hydraulic cylinder or motor for tuning the feed system and the magazine M1 around a turning joint against the drilling tool 8 and to thereby cause the bending. An advantage of this solution is that there is no need for heavy and large sized separate indexing devices. And further, there is no need to move the boom between drilling and charging positions.

Figure 8:
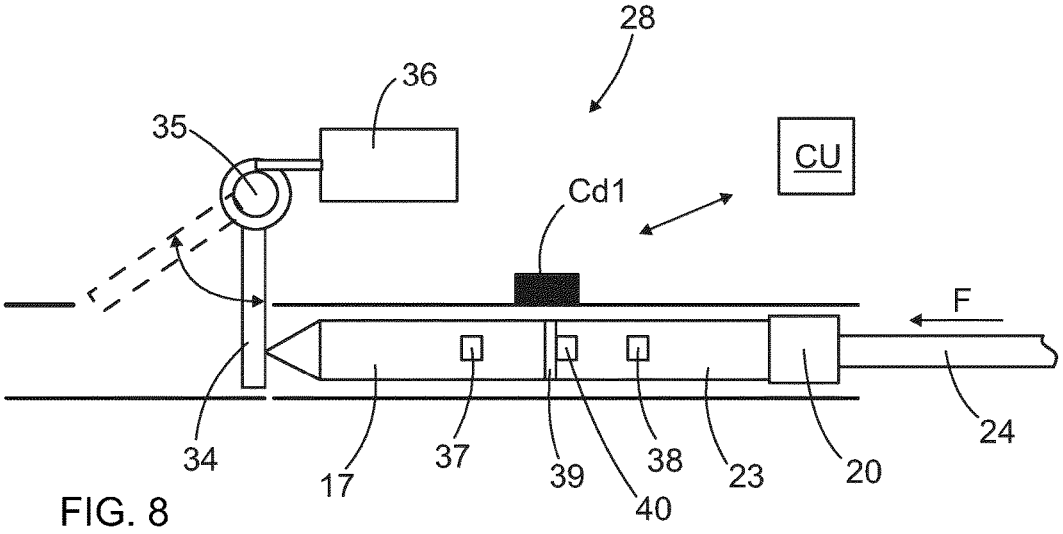
FIG. 8 is a schematic side view of an assembly unit provided with an openable and closable barrier and a communication device for inspecting success of executed assembly.

FIG. 8 discloses an assembly device 28 intended for connecting an initiator 17 and a booster 23 together. In this figure the initiator 17 is downstream relative to the booster 23, but it is also possible that their order is vice versa. Further, there may be several boosters. The booster 23 is pushed by means of a pushing cable 24 or hose or corresponding plunger towards the initiator 17 which is restrained by means of a stopping element 34. The stopping element 34 may be turned around a turning joint 35 by means of hydraulic or pneumatic cylinder 36, for example. As it disclosed already above the assembly unit 28 may be provided with a communicating device Cd1, which may communicate with the initiator 17 and if so desired, also with the booster 23. The initiator 17 and the booster 23 may be provided with tags 37, 38 for the communication. Further, a connection 39 between the initiator 17 and the booster 23 may comprise an electronic connection monitoring device 40, which may also communicate with the control device Cd1 and may send monitoring signals indicating success of the formed connection. The communication device Cd1 may send and receive data to a control unit CU. This control device CU may be located either on the drilling unit or may be external. The stopping element 34 may be provided with a force sensor for monitoring the force of the assembly between the at least one booster and the initiator. This sensor is to prevent executing too high pressing force and also for regulating the feeding system to manage correctly the assembly. The assembly module may also comprise an apparatus to allow the initiator to be properly orientated in case of optical reading or NFC communication. The proper orientation may be needed also in case of a specific assembly interface between booster and initiator.

Figure 9:
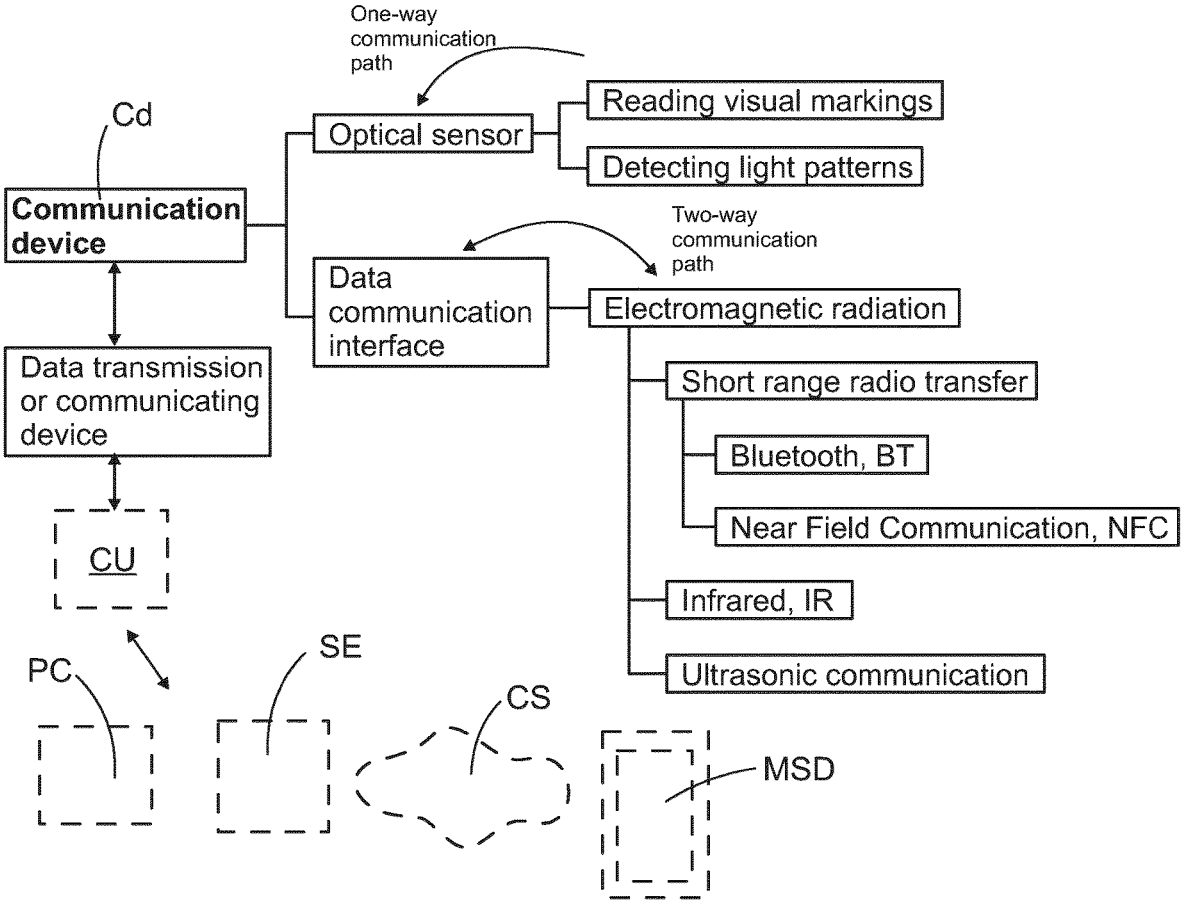
FIG. 9 is a simplified diagram disclosing features of a communication device.

FIG. 9 discloses some features relating to communication features of the disclosed communication device Cd. As can be seen there are various technologies that may be used for forming a wireless communication path with an initiator. The communication device is also provided with a data transmission system for communicating with a control unit CU. The control unit CU which is located in the drilling unit may communicate with personal computer PC, servers SE, cloud services CS and mobile smart devices MSD. Thereby, the sensed data may be shared wirelessly with desired electrical devices.

Figure 10:
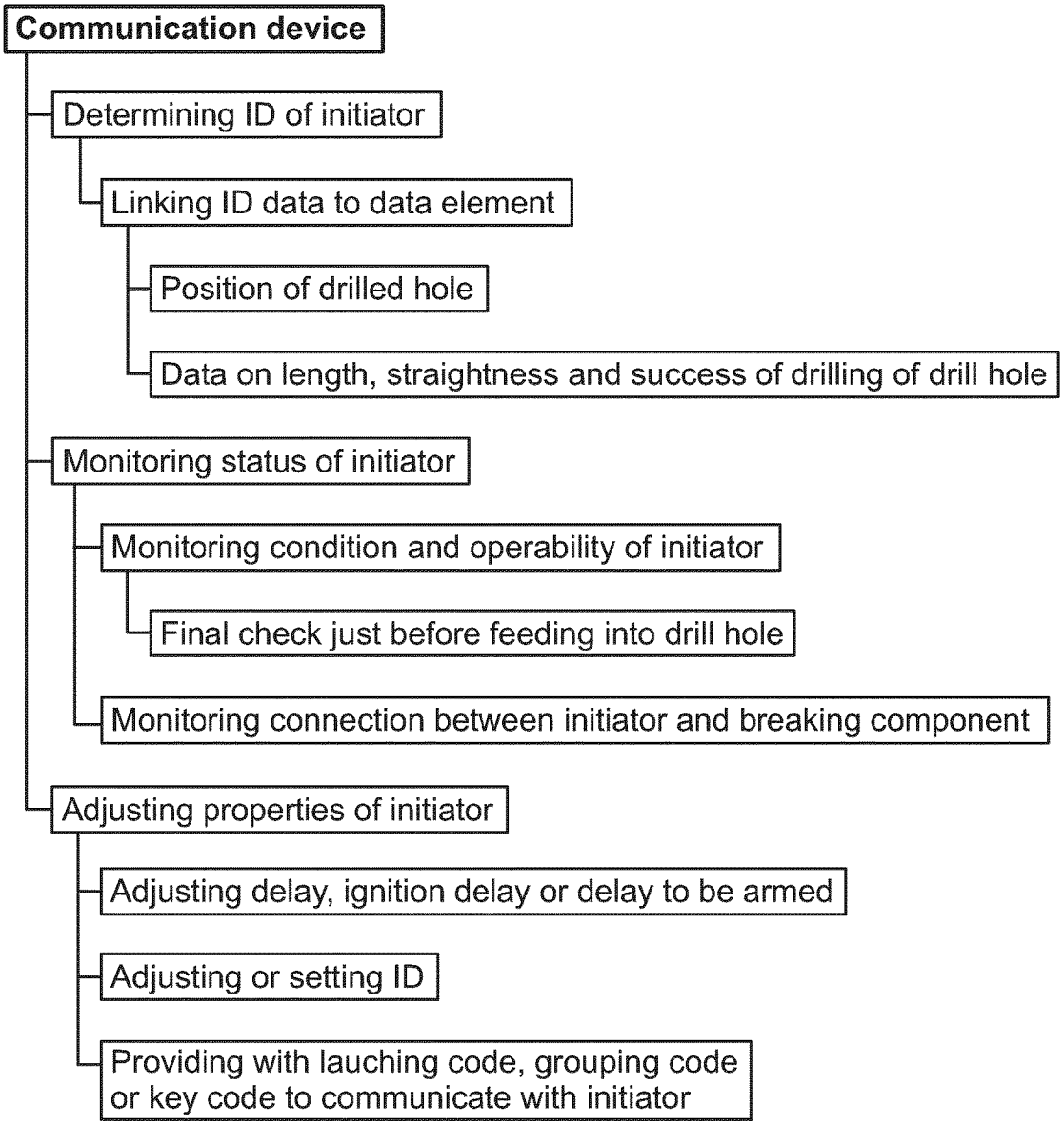
FIG. 10 is a simplified diagram showing possible use cases of a communication device.

FIG. 10 discloses some features of a communication device. The figure is self-explanatory and the presented issues have already been disclosed above in this document.

Figure 11:
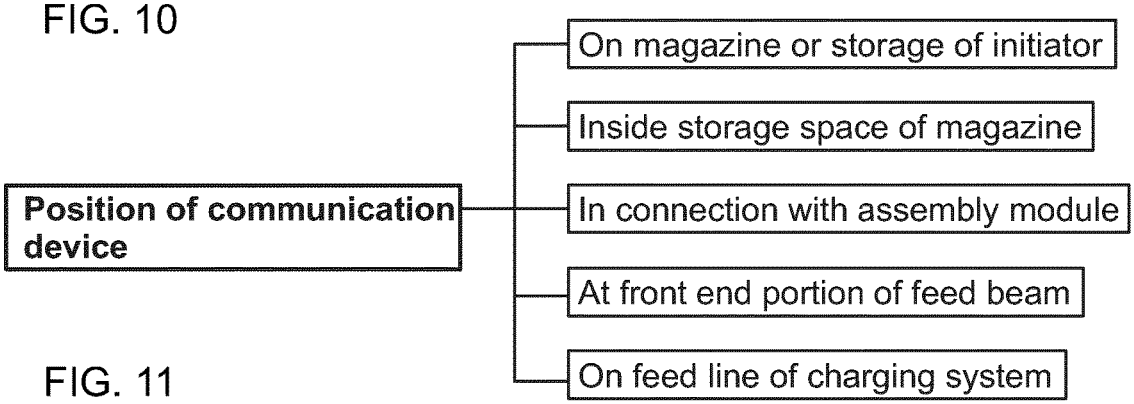
FIG. 11 is a simplified diagram showing possible mounting position for a communication device.

FIG. 11 is a simple listing of possible locations of a communicating device.

The drawings and the related description are only intended to illustrate the idea of the invention. In its details, the invention may vary within the scope of the claims.

The invention claimed is:

1. A rock drilling unit of a rock drilling rig, comprising:

a feed beam and a rock drilling machine supported movably on the feed beam for drilling holes; and an initiator feed system arranged for feeding initiators inside the drilled holes in order to activate rock breaking material also fed inside the drilled holes, wherein the initiator feed system of the drilling unit is provided with at least one communicating device for providing wireless communication with the initiators, the at least one communication device being in data connection with at least one control unit mounted onboard the rock drilling rig and arranged for controlling operation of the rock drilling machine and the initiator feed system, wherein the communication device is configured to determine identification of an initiator and provide identification data to link the initiator to at least one dedicated data element.

2. The rock drilling unit as claimed in claim 1, the at least one dedicated data element includes at least data on a drilled hole inside which the initiator is configured to be fed.

3. The rock drilling unit as claimed in a claim 1, wherein the control unit is provided with at least one drill hole data element for storing position data of the drilled holes and each initiator fed to the drilled hole is linked to the drill hole data element by means of individual identification code of the initiator, whereby position of the fed initiators is known.

4. The rock drilling unit as claimed in claim 1, wherein the communication device is provided with at least one optical sensor for remote reading visible markings or light patterns on outer surfaces of the initiators.

5. The rock drilling unit as claimed in claim 1, wherein the communication device is provided with at least one data communication interface for wireless communication with the initiator by means of electromagnetic radiation.

6. The rock drilling unit as claimed in claim 1, wherein the communication device is configured to monitor status of the initiator.

7. The rock drilling unit as claimed in claim 1, wherein the communication device is configured to adjust properties of the initiator.

8. The rock drilling unit as claimed in claim 1, wherein the communication device is configured to provide the initiator with at least one of the following input data: identification code (ID), location data, status data, delay for ignition, delay to be armed, key code to communicate with the initiator.

9. The rock drilling unit as claimed in claim 1, wherein the communication device is provided with at least one wireless data communication device for generating one-way data transmission path from the initiator to the communication device or vice versa.

10. The rock drilling unit as claimed in claim 1, wherein the communication device is provided with at least one wireless data communication device for generating a two-way data transmission path between the initiator and the communication device.

11. The rock drilling unit as claimed in claim 1, wherein the communication device is mounted on the feed beam and in connection with a feed line of the feed system.

12. The rock drilling unit as claimed in claim 1, further comprising at least one magazine for storing the initiators, wherein the communication device is mounted in connection with the magazine.

13. The rock drilling unit as claimed in claim 1, further comprising two magazines, wherein a first magazine is arranged for storing the initiators and a second magazine is arranged for storing rock breaking material, and wherein at least the first magazine is provided with the communicating device.

14. The rock drilling unit as claimed in claim 1, further comprising an assembly unit for connecting the initiator and a rock breaking cartridge to form an assembly, the assembly unit being provided with the connecting device for communicating with the assembly.

15. A rock drilling rig comprising:

a movable carrier;

at least one drilling boom connected movably to the carrier and equipped with a rock drilling unit in accordance with claim 1, wherein the rock drilling unit includes a rock drilling machine supported movably on the feed beam; and a control unit mounted onboard the movable carrier for controlling operation of the rock drilling machine and the initiator feed system of the rock drilling unit.

16. A method for charging drilled holes, wherein the method comprises:

drilling drill holes to a rock surface by means of a rock drilling machine of a rock drilling unit of a rock drilling rig;

a wireless initiator into the drill hole after the drilling is completed; and executing the feeding of the initiator by means of feeding means provided by the rock drilling unit; and providing the drilling unit with at least one communication device in data connection with at least one control unit mounted onboard the rock drilling rig and arranged for controlling operation of the rock drilling machine and the feeding means and communicating by means of the communication device with each initiator before being fed into the drilled hole.

17. The method as claimed in claim 16, further comprising determining identification of each initiator and connecting the initiator to at least one data element in response to the detected identification.

* * * * *